US005871027A

United States Patent [19]

Shimizu et al.

[11] Patent Number: 5,871,027

[45] Date of Patent: Feb. 16, 1999

[54] VACUUM VALVE CONTROLLER

[75] Inventors: Osamu Shimizu; Akihiro Ushitora, both of Kanagawa-ken, Japan

[73] Assignee: Ebara Corporation, Tokyo, Japan

[21] Appl. No.: 912,193

[22] Filed: Aug. 18, 1997

[30] Foreign Application Priority Data

Aug. 26, 1996 [JP] Japan ..... 8-244194

[51] Int. Cl.[6] ..... E03F 1/00; B65G 53/00; F16K 31/126; E03C 1/12

[52] U.S. Cl. ..... 137/205; 4/323; 137/236.1; 137/393; 137/395; 137/396; 137/403; 137/907; 141/65; 141/198; 406/14; 406/192

[58] Field of Search ..... 4/323; 137/205, 137/236.1, 386, 393, 395, 403, 413, 414, 907; 141/65, 198; 406/14, 15, 30, 50, 192

[56] References Cited

U.S. PATENT DOCUMENTS

| | | | |
|---|---|---|---|
| 3,853,138 | 12/1974 | Amren | 137/205 |
| 4,603,709 | 8/1986 | Huisma | 137/205 |
| 4,691,731 | 9/1987 | Grooms et al. | 137/205 |
| 5,069,243 | 12/1991 | Foreman | 141/198 |
| 5,588,458 | 12/1996 | Ushitora et al. . | |
| 5,615,701 | 4/1997 | Yamabe et al. | 141/198 |

FOREIGN PATENT DOCUMENTS

| | | |
|---|---|---|
| 0 415 359 A | 8/1990 | European Pat. Off. . |
| 0 678 631 A | 3/1995 | European Pat. Off. . |
| 7-39362 | 2/1995 | Japan . |
| 2 149 534 | 6/1985 | United Kingdom . |

*Primary Examiner*—George L. Walton
*Attorney, Agent, or Firm*—Armstrong, Westerman, Hattori, McLeland, & Naughton

[57] ABSTRACT

A vacuum valve controller for a vacuum sewer system having a suction pipe which is communicated with a vacuum system by opening a vacuum valve, and which is cut off from the vacuum system by closing the vacuum valve, so that soil water in a soil water basin is sucked through the suction pipe and sent to a predetermined place by opening said vacuum valve is disclosed. The vacuum valve controller comprises a vacuum valve actuating means movable between a first position and a second position for actuating the vacuum valve between an open position and a closed position, respectively, means for normally biasing the vacuum valve actuating means to the second position, a pressure sensing tube for converting a change in level of soil water in the soil water basin to a change in pressure, a first pressure chamber communicated with the pressure sensing tube and associated with the vacuum valve actuating means for moving the vacuum valve actuating means to the first position when a level in the soil water basin reach a predetermined level, and means for urging the vacuum valve actuating means to the second position while soil water is sucked through the suction pipe. The first pressure chamber is so associated with the vacuum valve actuating means that the pressure chamber is capable of moving the vacuum valve actuating means to the first position while being incapable of moving the vacuum valve actuating means to the second position. By this means, it is possible to prevent the vacuum valve from moving to the closed position while the soil water is sucked through the suction pipe even if a negative pressure is established in the first pressure chamber whereby any water-hammer may be prevented.

7 Claims, 4 Drawing Sheets

VACUUM VALVE CONTROLLER

BACKGROUND OF THE INVENTION

The present invention relates to a vacuum valve controller for controlling a vacuum valve for use in a vacuum transfer system for transferring soil water accumulated in a soil water basin to a predetermined place, such as a sewage disposal plant. The vacuum transfer system sucks the soil water from the soil water basin through a suction pipe by opening the vacuum valve.

There has been proposed a vacuum soil water transfer system which utilizes a vacuum for transferring soil water accumulated in each of a plurality of broadly distributed soil water basins to a predetermined place, such as a sewage disposal plant. In such a vacuum soil water transfer system, each soil water basin is provided with a soil water suction pipe, a vacuum valve for selectively communicating the suction pipe with a vacuum system and a vacuum valve controller for controlling the vacuum valve to open and close depending on the level of the soil water accumulated in the soil water basin.

FIGS. 3 and 4 show an exemplified system arrangement using a prior art vacuum valve controller of the type described above, which is disclosed in Japanese Patent Application No. Hei-7-39362 (No. 39362/1995). In FIGS. 3 and 4, reference numeral 1 denotes a soil water basin, which is provided with a suction pipe 3 having a distal end disposed in the soil water basin 1 and a proximal end connected to a line 5 (forming a part of a vacuum system) through a vacuum valve 4 having a valve body 6. The line 5 is in communication with a vacuum tank (not shown). The vacuum valve 4 further includes a diaphragm 4*b* and a spring 4*a* for biasing the diaphragm 4*b*, both housed in a piston chamber 4*c*.

Reference numeral 11 denotes a controller, which comprises a casing 12 having a large-diameter portion 12*a* and a smaller-diameter portion 12*b* contiguous to the larger-diameter portion 12*a*. The larger-diameter portion 12*a* has a partition wall 15 formed therein substantially at the center of the larger-diameter portion 12*a* and dividing the inside of the larger-diameter portion 12*a* into left- and right-hand regions. The partition wall 15 has a hole formed therein through which extends a shaft 14 supporting a valve body 13. The left-hand region, in turn, is divided into first and second pressure chambers 17 and 18 by means of a first diaphragm or a sensor diaphragm 16 provided substantially at the center of the left-hand region. The right-hand region, in turn, is divided into third and fourth pressure chambers 20 and 21 by means of a second diaphragm 19 provided substantially at the center of the right-hand region. Further, the inside of the smaller-diameter portion 12*b* is divided into left- and right-hand regions by means of a partition wall 22. The left-hand region of the smaller-diameter portion 12*b* defines a chamber which is contiguous to and in communication with the fourth chamber 21. The right-hand region of the smaller-diameter portion 12*b*, in turn, is divided into fifth and sixth pressure chambers 24 and 25 by means of a partition wall 23.

The valve body 13, which is secured to a distal end of the shaft 14, is disposed in the sixth chamber 25. The proximal end of the shaft 14 is fixedly secured to the first diaphragm 16 at the center thereof by means of a screw 14*a*. The shaft 14 extends through the partition wall 15, as well as through the second diaphragm 19 (which is fixedly secured to the shaft 14). The shaft 14 further extends through the partition walls 22 and 23. A seal 26 is provided between the shaft 14 and the partition wall 15 and another seal 27 is provided between the shaft 14 and the partition wall 22. The partition wall 23 has a through hole 23*a* formed therein, through which the shaft 14 extends, and which may be closed by the valve body 13. A spring 28 is provided for urging the second diaphragm 19 in a leftward direction seen in the figure.

A magnet 29 is provided on the rear end wall of the casing 12 at a position where it faces the rear end (or the proximal end) of the shaft 14, and more specifically the above-mentioned screw 14*a* made of a suitable ferromagnetic material and which is threadingly secured to the rear end of the shaft 14. The sixth chamber 25 has a hole 30 for communicating with the atmosphere, which may be opened or closed by the valve body 13. The suction pipe 3 has pressure detection holes 9 and 10 provided at different levels, with a predetermined spacing in the vertical direction defined between the holes 9 and 10. One pressure detection hole 9 is in communication with the fourth chamber 21 through a pipe 31, while the other pressure detection hole 10 is in communication with the third chamber 20 through a pipe 32. A pressure sensing tube 2 is disposed in the soil water basin 1 and in communication with the first chamber 17 through a pipe 33. The second chamber 18 is in communication with the atmosphere through a hole 34. The fifth chamber 24 is in communication with the line 5 through a pipe 35 and the sixth chamber 25 is in communication with the piston chamber 4*c* of the vacuum valve 4 through a pipe 36.

In the vacuum valve controller having the above arrangement, as the level of soil water in the soil water basin 1 rises, the pressure in the pressure sensing tube 2 builds up, and this pressure is led through the pipe 33 into the first chamber 17 in the controller 11. By means of the pressure in the first chamber 17, the first diaphragm 16 is displaced in the rightward direction against the biasing force of the spring 28 as well as against the magnetic attraction force of the magnet 29, so that the shaft 14 is displaced in the right direction to cause the valve body 13 to close the hole 30 communicating with the atmosphere. Thus, the vacuum in the line 5 is led through the pipe 35 into the fifth and sixth chambers 24 and 25, and thence into the piston chamber 4*c* of the vacuum valve 4. By this, the valve body of the vacuum valve 4 is lifted away from the valve seat 7.

In the above sequence of operations, when the first diaphragm 16 is displaced by the pressure built-up in the pressure sensor tube 2 and the shaft 14 starts to move, the biasing force provided by the spring 28 gradually increases with the displacement of the shaft 14, while the attraction force provided by the magnet 29 suddenly decreases (proportional to the square of the displacement). Accordingly, the shaft 14 snaps into its displacement limit, or closing position, where the hole 30 is closed by the valve body 13. It should be noted that the holes 23*a* and 30, the fifth and sixth chambers 24 and 25, the valve body 13 and the shaft 14 together form a vacuum valve actuating means for opening and closing the vacuum valve 4.

When the valve body 6 is lifted away from the valve seat 7, the line 5 and the suction pipe 3 are communicated with each other, so that soil water in the soil water basin 1 is sucked into the line 5 through the suction pipe 3. This produces a pressure difference between the pressure detection holes 9 and 10, and the different pressures at the pressure detection holes 9 and 10 are led through the pipes 31 and 32 to the fourth and third chambers 21 and 20, respectively. As a result, the pressure difference therebetween acts on the second diaphragm 19 to displace it in a rightward direction, so that the valve body 13 is further pressed against the hole 30 through the shaft 14. Thus, as the level of soil water in the soil water basin 1 is lowered by sucking the soil water from the basin 1, and even the pressure difference between the first and second chambers 17 and 18 is reduced to zero, the valve body 13 remains pressed against the hole 30 by virtue of the rightward force provided by the pressure difference between the fourth and third chambers 21 and 20. The pressure difference lasts as long as soil water flows into the line 5 through the suction pipe 3.

When the soil water level in the basin 1 is further lowered and air begins to be sucked into the suction pipe 3 through its lower end, the pressure difference between the pressure detection holes 9 and 10 is lost. Consequently, the second diaphragm 19 is displaced in the leftward direction by means of the spring 28, so that the valve body 13 is pressed against the through hole 23*a* formed in the partition wall 23 to close the through hole 23*a*. Since the hole 30 is thus opened, atmospheric air flows into the sixth chamber 25 through the hole 30, and thence into the piston chamber 4*c* of the vacuum valve 4 through the pipe 36. As the result, the valve body 6 is moved back into the closed position by the biasing force of the spring 4*a*. Thus, the valve body 6 closes the valve port in the valve seat 7 and shuts off communication between the suction pipe 3 and the line 5.

The prior art vacuum valve controller having the arrangement described above, however, suffers from a problem as follows. Namely, in a case where a leakage occurs in the pressure sending tube 2 and when a water level in the basin 1 is lowered, a soil water column may be formed in the pressure sensing tube 2. In another case, it is also possible that the vacuum valve controller 11 and the pressure sensing tube 2 are initially connected to each other with a soil water column inadvertently left in the pressure sensing tube 2. In either case, the pressure in the pressure sensing tube 2 becomes negative when the soil water in the basin 1 is sucked through the vacuum valve 4, thereby lowering the soil water level in the basin 1 to a certain level near the lower end of the suction pipe 3. Due to the negative pressure in the pressure sensing tube 2, the first diaphragm 16 may be displaced back to its standby position or leftward limit position forcibly. If this occurs, the shaft 14 is also moved back to its standby position, and, thus, the valve body 6 of the vacuum valve 4 forcibly closes the valve port in the valve seat 7 while the soil water is sucked from the basin 1. This results in an occurrence of water-hammer in a region of the vacuum valve 4 upstream of the valve body 6, which leads to a possible, unintended disconnection of the vacuum valve 4 from the suction pipe 3.

In view of the foregoing, it is an object of the present invention to provide a vacuum valve controller for controlling a vacuum valve, which can prevent any forced closing of the vacuum valve during suction of soil water from a soil water basin, even when a soil water column is formed in a pressure sensing tube due to a possible leakage occurring in the sensing tube or for some other reason, and which ensures that the vacuum valve is actuated to close only after air is sucked through the suction pipe.

SUMMARY OF THE INVENTION

According to the present invention, in a vacuum valve controller for a vacuum sewer system having a suction pipe which is communicated with a vacuum system by opening a vacuum valve, and which is cut off from the vacuum system by closing the vacuum valve, so that soil water in a soil water basin is sucked through the suction pipe and sent to a predetermined place by opening said vacuum valve, the vacuum valve controller comprises a vacuum valve actuating means which is movable between a first position and a second position for actuating the vacuum valve between an open position and a closed position, respectively, means for normally biasing the vacuum valve actuating means to the second position, a pressure sensing tube for converting a change in level of soil water in the soil water basin to a change in pressure, a first pressure chamber communicated with the pressure sensing tube and associated with the vacuum value actuating means for moving the vacuum valve actuating means to the first position when a level in the soil water basin reaches a predetermined level, and means for urging the vacuum valve actuating means to the second position while soil water is sucked through the suction pipe.

The first pressure chamber is so associated with the vacuum valve actuating means that the pressure chamber is capable of moving the vacuum valve actuating means to the first position while being incapable of moving the vacuum valve actuating means to the second position.

Thus, it is possible to prevent the vacuum valve actuating means from moving to the second position, or the vacuum valve moving to the closed position, even if a negative pressure is established in the first pressure chamber while soil water is sucked through the suction pipe. This ensures that the vacuum valve is moved to the closed position only after air is sucked through the suction pipe and any water-hammer may be effectively prevented.

The vacuum valve actuating means may be constituted so that it includes a valve means for selectively communicating a piston chamber of the vacuum valve to a vacuum source or an atmosphere to open or close the vacuum valve, and a reciprocable shaft supporting the switching valve. The vacuum source may be provided from the vacuum system positioned down-stream of the vacuum valve.

Typically, the first pressure chamber includes a first pressure responsive diaphragm and the diaphragm is separated from the shaft of the vacuum valve actuating means so that the diaphragm is capable of pushing the shaft to move the vacuum valve actuating means to the first position, while it is incapable of pulling the shaft to move the vacuum valve actuating means to the second position.

Also, it is preferable that the means for urging the vacuum valve actuating means comprises a second pressure responsive diaphragm associated with the reciprocable shaft, and a pair of pressure chambers are provided on both sides of the second diaphragm. The pressures in the suction pipe at different levels are led into the pair of pressure chambers provided on both sides of the second diaphragm so that a pressure difference therebetween serves to move the vacuum valve actuating means to the first position against a force of the biasing means.

The first diaphragm is preferably made of a ferromagnetic material, and a magnet is provided in the first pressure chamber facing the first diaphragm so that magnetic attraction force is applied to the first diaphragm in the direction away from the reciprocable shaft.

The vacuum valve actuating means, the reciprocable shaft, the first and second pressure chambers, and the first and second diaphragms are preferably received in a single casing.

The above and other objects, features and advantages of the present invention will become more apparent from the following description when taken in conjunction with the accompanying drawings in which a preferred embodiment of the present invention is shown by way of illustrative examples.

PREFERRED EMBODIMENT OF THE INVENTION

Figure 1:
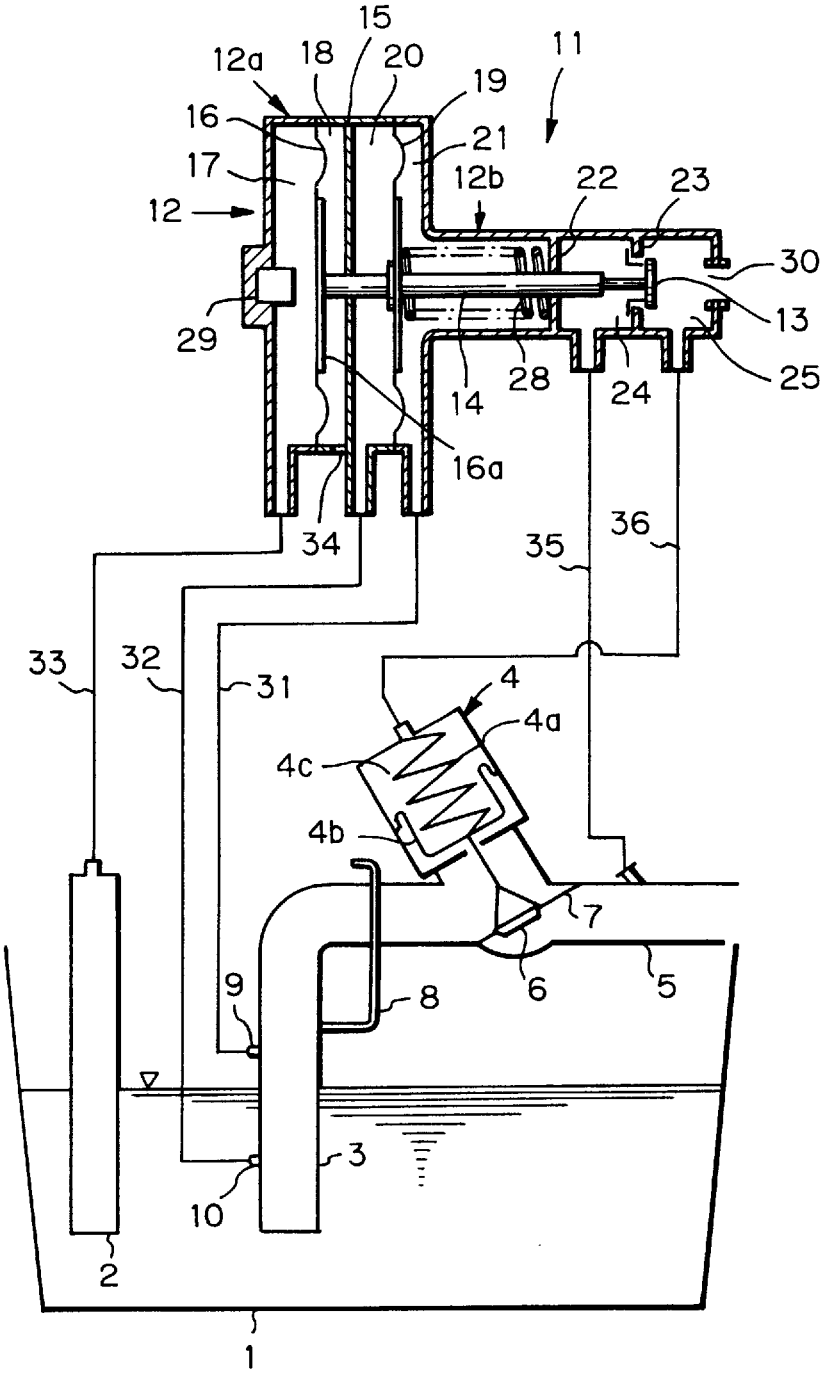
FIG. 1 shows the arrangement of a vacuum sewer system that employs the vacuum valve controller according to the present invention.
Figure 2:
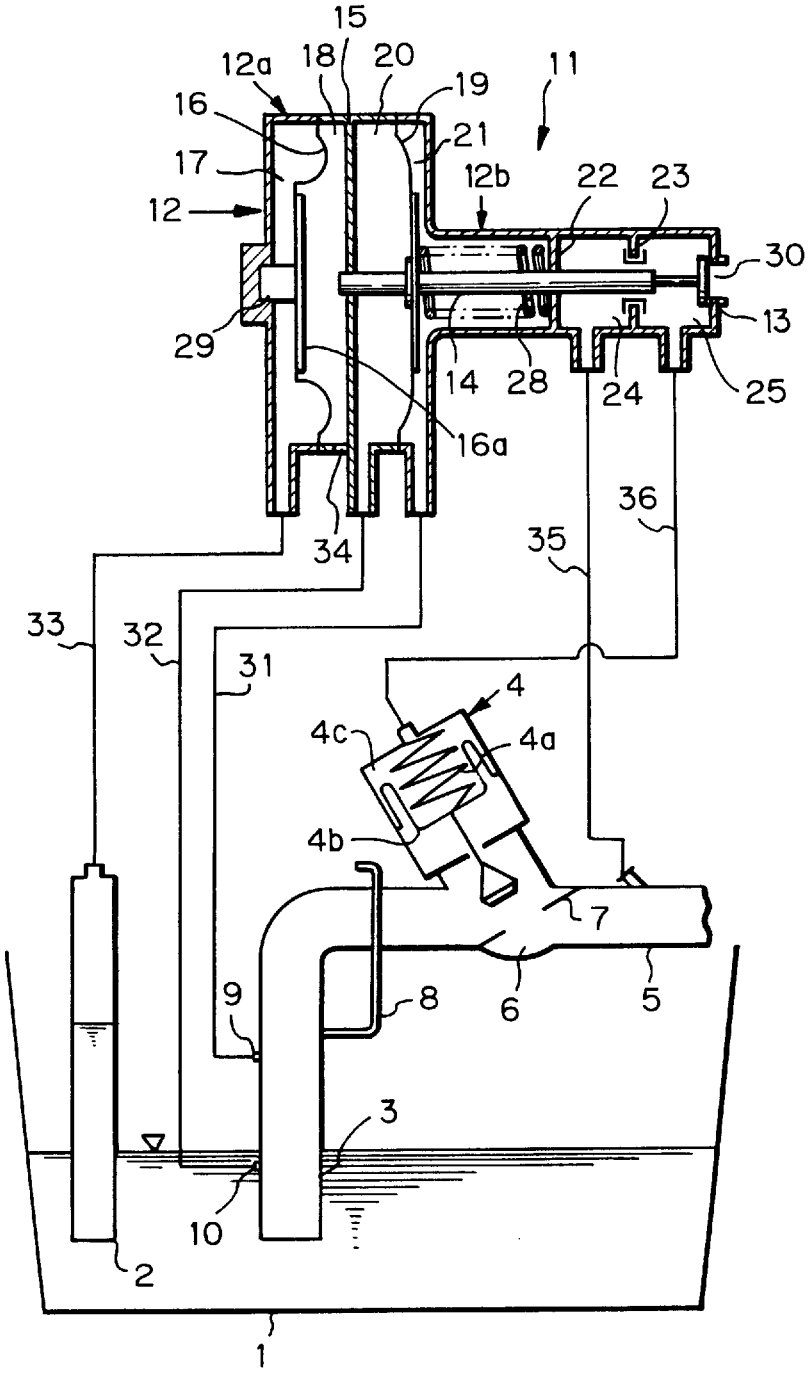
FIG. 2 is a view similar to FIG. 1, but the vacuum valve controller according to the present invention is in other operating position for illustrating the operation thereof.

Referring now to the accompanying drawings, an embodiment of the present invention will be described. FIG. 1 shows a system arrangement using a vacuum valve controller of the present invention, and FIG. 2 illustrates the operation of the vacuum valve controller when the pressure in the pressure sending tube becomes negative, which is experienced when a soil water column is formed in the pressure sensing tube due to, for example, a leak in the pressure sensing tube and, then, the soil water level in the soil water basin is lowered by sucking the soil water through the vacuum valve.

Figure 3:
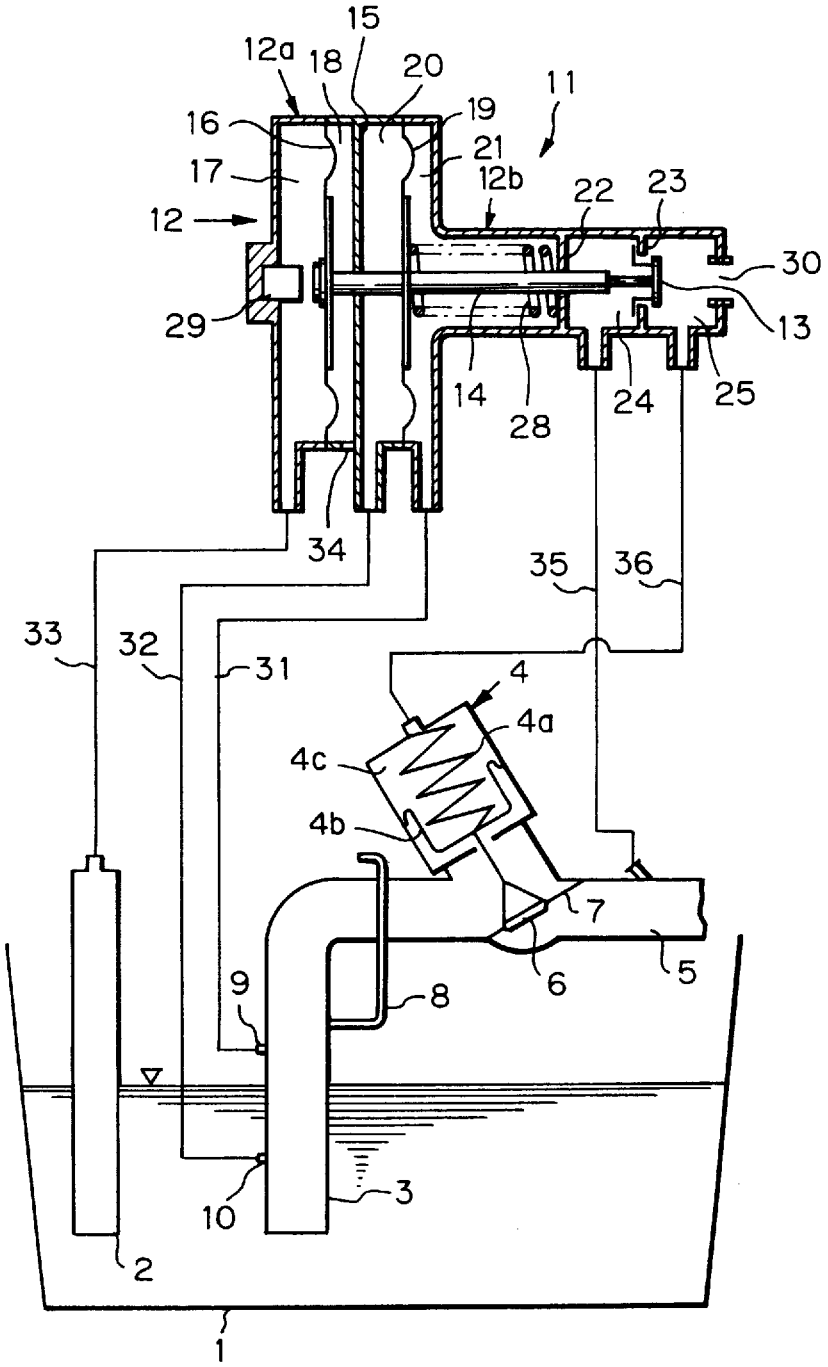
FIG. 3 shows the arrangement of a vacuum sewer system using a prior art vacuum valve controller.
Figure 4:
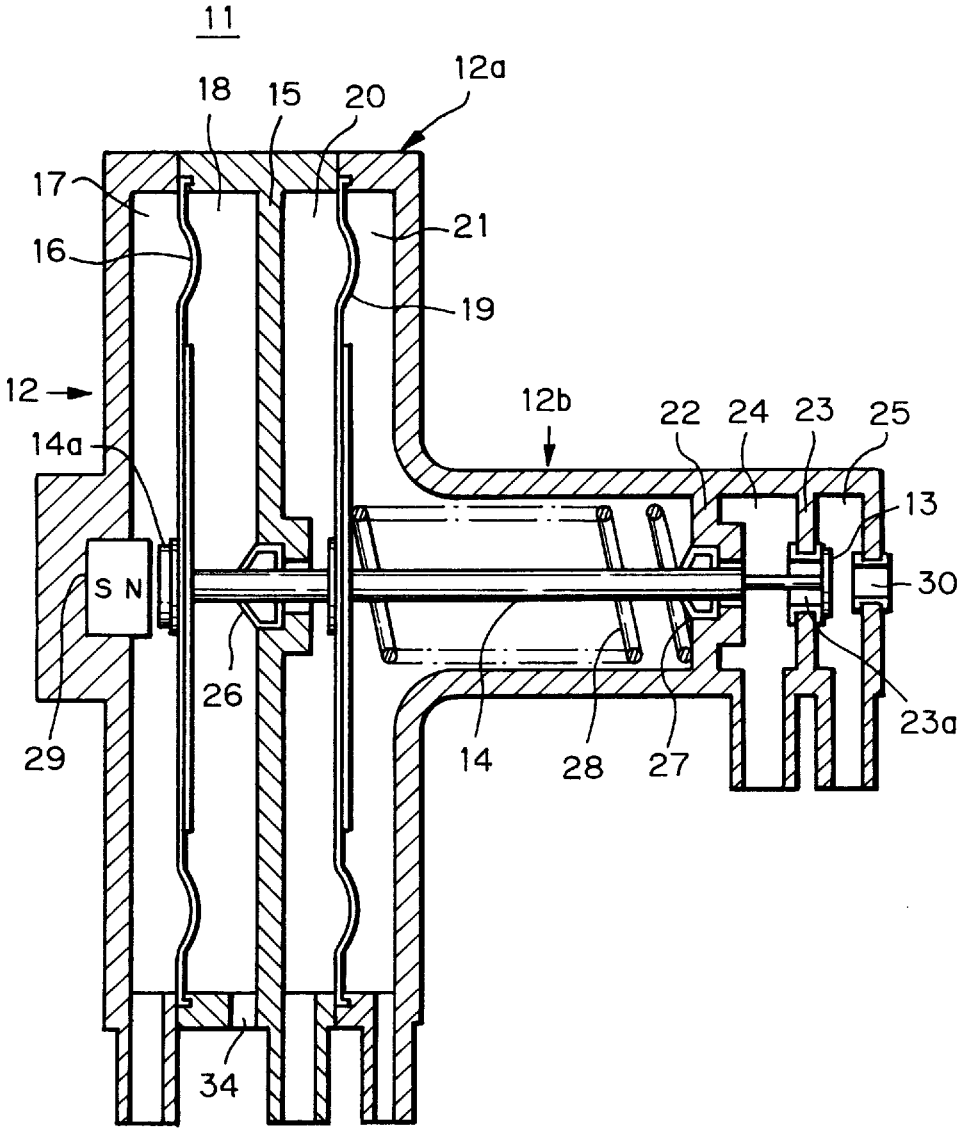
FIG. 4 is an enlarged sectional view of the prior art vacuum valve controller.

The arrangement of the vacuum valve controller according to the present invention shown in FIG. 1 is similar to that of the prior art vacuum valve controller shown in FIGS. 3 and 4 except for the following point. In the arrangement shown in FIGS. 3 and 4 the rear or left end of the shaft 14 is fixedly secured to the first diaphragm 16 at the center thereof by means of the securing screw 14*a* (formed of a ferromagnetic material), whereas in the arrangement shown in FIG. 1 the rear end of the shaft 14 and a center disk portion 16*a* of the first diaphragm 16 (made of a ferromagnetic material) are separated or unconnected from each other. Thus, the first diaphragm 16 is capable of acting on the shaft 14 so as to move the shaft 14 in a rightward direction while being incapable of acting on the shaft 14 so as to move the shaft 14 in a leftward direction.

In the vacuum valve controller of FIG. 1 having the above arrangement, as the level of the soil water in the soil water basin 1 rises, the pressure in the pressure sensing tube 2 builds up, and this pressure is led through the pipe 33 into the first chamber 17 in the controller 11. By means of the pressure in the first chamber 17, the first diaphragm 16 (made of a ferromagnetic material) is displaced in a rightward direction against the biasing force provided by the spring 28 as well as against the attraction force provided by the magnet 29, so that the shaft 14 is pushed by the first diaphragm 16 in this direction to cause the valve body 13 to close the hole 30 communicating with the atmosphere. Accordingly, the vacuum in the line 5 is led through the pipe 35 into the fifth and sixth chambers 24 and 25, and thence into the piston chamber 4*c* of the vacuum valve 4 through the pipe 36. Thus, the valve body 6 of the vacuum valve 4 is lifted away from the valve seat 7.

When the valve body 6 is lifted away from the valve seat, the line 5 and the suction pipe 3 are communicated with each other, so that the soil water in the soil water basin 1 is sucked into the line 5 through the suction pipe 3. This produces a pressure difference between the pressure detection holes 9 and 10, and the different pressures at the pressure detection holes 9 and 10 are led through the pipes 31 and 32 to the fourth and third chambers 21 and 20, respectively. As a result, a corresponding differential pressure acts on the diaphragm 19 to urge it in the rightward direction, so that the valve body 13 is further pressed against the hole 30 through the shaft 14. As the level of the soil water in the soil water basin 1 is lowered by sucking of the soil water from the basin 1, the pressure difference between the first and second chambers 17 and 18 is gradually reduced to zero. However, even when this pressure difference has been lost, the valve body 13 remains pressed against the hole 30 by virtue of the rightward force provided by the pressure difference between the fourth and third chambers 21 and 20, which pressure difference is kept as long as soil water flows through the suction pipe 3.

A soil water column may be formed in the pressure sensing tube 2 while the vacuum valve 4 is open so as to start sucking the soil water from the soil water basin 1. This may occur, for example, due to a possible leakage occurring in the pressure sensing tube 2. In such a case, the soil water level in the pressure sensing tube 2 may become higher than that in the soil water basin 1 after some amount of soil water is sucked out of the basin 1, as shown in FIG. 2, leading to a negative pressure produced in the pressure sensing tube 2. This lowers the pressure in the first chamber 17, resulting in displacement of the sensor diaphragm 16 in a leftward direction. However, since the rear end of the shaft 14 and the sensor diaphragm 16 are separate from each other, no force is applied to the shaft 14 from the sensor diaphragm 16 being displaced in a leftward direction, and thus the shaft 14 remains unmoved. This effectively prevents the shaft 14 from being pulled in a leftward direction by the sensor diaphragm 16 being displaced, which, unlike the prior art vacuum valve controller described above, prevents a sudden and forced closing of the valve port by the valve body 6 while the soil water is sucked from the basin 1 through the suction pipe 3. Accordingly, the vacuum valve controller of the present invention allows no water-hammer to occur in a region of the vacuum valve 4 upstream of the valve body 6, and is free from any problems which could result from such water-hammer.

As the suction pipe 3 continues sucking the soil water from the basin 1, the soil water level in the basin 1 further lowers until air is sucked into the suction pipe 3 through its lower end. Then, the pressure difference between the pressure detection holes 9 and 10 is lost. Consequently, the diaphragm 19 is displaced in the leftward direction by means of the spring 28, so that the valve body 13 is pressed against the through hole 23*a* formed in the partition wall 23 to close the through hole 23*a*. Since the hole 30 is opened, atmospheric air flows through the hole 30 into the sixth chamber 34, and thence through the pipe 36 into the piston chamber 4*c* of the vacuum valve 4. As a result, the valve body 6 is moved back to the closed position by the biasing force of the spring 4*a*. Thus, the valve body 6 closes the valve port defined in the valve seat 7 and shuts off communication between the suction pipe 3 and the line 5.

As is apparent from the foregoing description of an embodiment of the present invention, the first diaphragm and the shaft are separate from each other, the first diaphragm is capable of acting on the shaft in a direction for opening the vacuum valve while being incapable of acting on the shaft in a direction for closing the vacuum valve. Thus, it is possible to prevent any forced closing of the vacuum valve while the soil water is sucked from the soil water basin, even when there is a soil water column in a pressure sensing tube or the soil water level in the pressure sensing tube becomes higher than that in the basin and the pressure in the pressure sensing tube becomes negative. It, therefore, ensures that the vacuum valve is closed only after air is sucked into the suction pipe, so that any water-hammer may be positively prevented.

What is claimed is:

1. vacuum valve controller for a vacuum sewer system having a suction pipe which is communicated with a vacuum system by opening a vacuum valve, and which is cut off from the vacuum system by closing said vacuum valve, so that soil water in a soil water basin is sucked through said suction pipe and sent to a predetermined place by opening said vacuum valve, said vacuum valve controller comprising:

a vacuum valve actuating means moveable between a first position and a second position for actuating said vacuum valve between an open position and a closed position, respectively;

means for normally biasing said vacuum valve actuating means to said second position;

a pressure sensing tube for converting a change in level of soil water in said soil water basin to a change in pressure;

a first pressure chamber communicated with said pressure sensing tube and associated with said vacuum valve actuating means for moving said vacuum valve actuating means to the first position when a level in said soil water basin reaches a predetermined level; and means for urging said vacuum valve actuating means to said first position while soil water is sucked through said suction pipe, wherein said first pressure chamber is so associated with said vacuum valve actuating means that said first pressure chamber is capable of moving said vacuum valve actuating means to said first position while being incapable of moving said vacuum valve actuating means to said second position.

2. A vacuum valve controller claimed in claim 1, wherein said vacuum valve actuating means includes:

valve means for selectively communicating a piston chamber of said vacuum valve to a vacuum source in said first position and communicating the piston chamber of said vacuum valve to an atmosphere in said second position; and a reciprocable shaft supporting said valve means.

3. A vacuum valve controller claimed in claim 2, wherein said vacuum source is provided from said vacuum system positioned downstream of said vacuum valve.

4. A vacuum valve controller claimed in claim 2 or 3, wherein said first pressure chamber includes a first pressure responsive diaphragm, said diaphragm is separated from said shaft of said vacuum valve actuating means so that said diaphragm is capable of pushing said shaft to move said shaft of said vacuum valve actuating means to said first position, while being incapable of pulling said shaft to move said vacuum valve actuating means to said second position.

5. A vacuum valve controller claimed in claim 2 or 3 wherein said means for urging said vacuum valve actuating means comprises a second pressure responsive diaphragm associated with said reciprocable shaft, and a pair of pressure chambers provided on both sides of said second diaphragm, wherein pressures in said suction pipe at different levels are led into said pair of pressure chambers provided on both sides of said second diaphragm so that a pressure difference therebetween serves to move said vacuum valve actuating means to the first position against a force of said means for normally biasing.

6. A vacuum valve controller claimed in claim 4, wherein said first diaphragm is made of a ferromagnetic material, and a magnet is provided in said first pressure chamber facing said first diaphragm so that a magnetic attraction force is applied to said first diaphragm in the direction away from said reciprocable shaft.

7. A vacuum valve controller claimed in claim 5, wherein said vacuum valve actuating means, said reciprocable shaft, said first and second pressure chambers, and said first and second diaphragms are received in a single casing.

* * * * *